US005788579A

United States Patent [19]

Cherry et al.

[11] Patent Number: 5,788,579

[45] Date of Patent: Aug. 4, 1998

[54] ILLUSION MIRROR LIGHT DISPLAY

[76] Inventors: Steve R. Cherry, 10253 Calvin Ave., Northridge, Calif. 91324; Bernard F. Mikelis, 13190 Tonopah St., Arleta, Calif. 91331

[21] Appl. No.: 782,635

[22] Filed: Jan. 14, 1997

[51] Int. Cl.[6] ..... A63G 31/00

[52] U.S. Cl. ..... 472/63; 40/219; 359/846

[58] Field of Search ..... 472/57, 61, 63; 362/135, 140, 136; 40/219, 900, 427, 738; 359/846, 847

[56] References Cited

U.S. PATENT DOCUMENTS

| | | | |
|---|---|---|---|
| 2,129,513 | 9/1938 | Wegener | 359/846 |
| 2,222,301 | 11/1940 | Rappaport . | |
| 4,164,823 | 8/1979 | Marsico | 40/219 X |
| 4,761,004 | 8/1988 | Hargabus . | |
| 5,016,998 | 5/1991 | Butler et al. | 359/846 X |

FOREIGN PATENT DOCUMENTS

| | | | |
|---|---|---|---|
| 581389 | 7/1933 | Germany . | |
| 2 029 067 | 3/1980 | United Kingdom | 40/219 |

*Primary Examiner*—Kien T. Nguyen

*Attorney, Agent, or Firm*—Thomas I. Rozsa; Tony D. Chen

[57] ABSTRACT

An illusion mirror light display has a frame with a view opening, a front partially reflective mirror, a second fully reflective mirror, a middle frame member located between the front and second mirrors, one or more light sources installed on the periphery of the middle frame member for displaying a lighting illusion effect which is viewed through the view opening, and retaining members for retaining all of the elements within the frame. When the illusion mirror light display is activated, it provides an illusion effect. The illusion mirror light display also has pressure points for causing the light sources to emit at that location.

21 Claims, 2 Drawing Sheets

ILLUSION MIRROR LIGHT DISPLAY

BACKGROUND OF THE INVENTION

1. Field of the Invention

The present invention generally relates to the field of mirror displays. More particularly, the present invention relates to the field of light illusion displays.

2. Description of the Prior Art

A light illusion effect shows images of the same object repeated endlessly, but with each new image somewhat smaller and appearing farther away. One of the disadvantages is that the object repeating endlessly cannot be redirected from a different location. Basically, in the prior art, the images are repeating endlessly at a fixed location.

The following three (3) prior art patents are found to be pertinent to the field of the present invention:

1. U.S. Pat. No. 2,222,301 issued to Rappaport on Nov. 19, 1940 for "Method And Apparatus For Producing Multiple Reflections" (hereafter "the Rappaport Patent");
2. U.S. Pat. No. 4,761,004 issued to Hargabus on Aug. 2, 1988 for "Infinity Mirror Display" (hereafter "the Hargabus Patent"); and
3. German Patent No. 581,389 (hereafter "the German Patent").

The Hargabus Patent discloses an infinity mirror display. It comprises a partially transparent, or two-way mirror which is positioned in front of and spaced from a fully reflecting mirror. Holes passing through the fully reflecting mirror from its rear surface to its front surface provide a passage for light, whereas the present invention does not have holes passing through the fully reflecting mirror.

The Rappaport Patent discloses a method and apparatus for producing multiple reflections. It comprises an enclosure which has a front wall to receive a transparent mirror, a back wall to receive a true mirror and a middle frame member. At the bottom end of the frame member is provided a groove to receive an object to be reflected. The middle frame member has a pair of lights attached at the periphery thereto for the object to be reflected such that a multiple series of reflections of the object extends apparently into infinity.

The German Patent, as disclosed from the figures shows a mirror light display. It comprises a front partially reflective mirror, a back fully reflective mirror and a frame member located between the front and back mirrors. The frame member has top and bottom lights to reflect an object placed between the mirrors.

It is desirable to provide an illusion mirror light display with the capability of directing the images at different locations, thereby producing an illusion effect at different locations on the mirror light display.

SUMMARY OF THE INVENTION

The present invention is a unique illusion mirror light display which comprises an outer frame member with a viewing area, a first partially reflective mirror, a second fully reflective mirror, an inner frame member located between the first and second mirrors, one or more light sources installed at the periphery of the inner frame member for displaying a lighting illusion effect which is viewed through the viewing area, and means for retaining all of the elements within the outer frame. When the illusion mirror light display is activated, it produces an illusion effect. The illusion mirror light display also has pressure points for causing the light sources to emit at different location. For example, if the pressure point is located adjacent to the left side of the light display, the light sources will emit to the left side of the light display or if the pressure point is located adjacent to the right side of the light display, the light sources will emit to the right side of the light display. The light sources emit where the pressure point is located.

It is therefore an object of the present invention to provide an illusion mirror light display having one or more light sources at any desired location within the viewing area of the light display.

It is an additional object of the present invention to provide an illusion mirror light display in which the orientation of the light sources causes the successive images to appear as continuous light lines or columns.

It is a further object of the present invention to provide an illusion mirror light display having one or more pressure points for redirecting the successive images at different locations within the light display.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Figure 1:
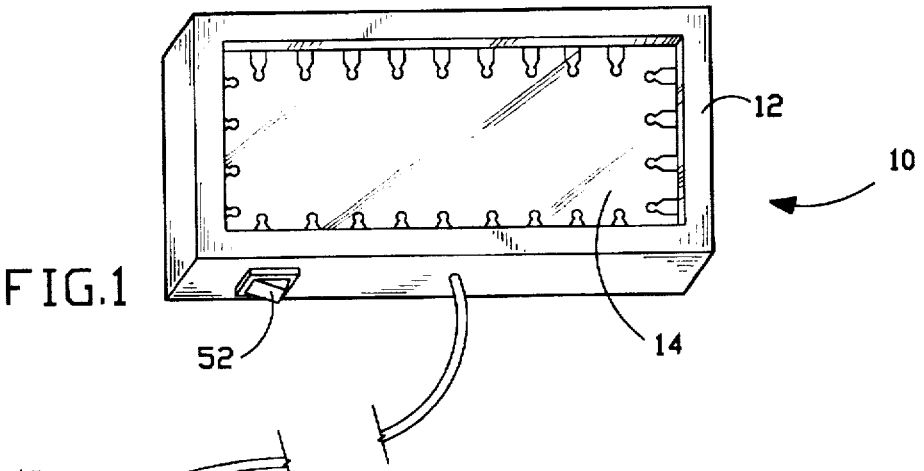
FIG. 1 is a front perspective view of the present invention illusion mirror light display.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 4, there are shown the present invention illusion mirror light display which comprises an outer frame member 12, a first mirror 14, a second mirror 18, an inner frame member 16 located between the first and second mirrors 14 and 18, a plurality of light bulbs 24 or light sources, a backing member 20, and one or more adjustable screw means 22.

Figure 3:
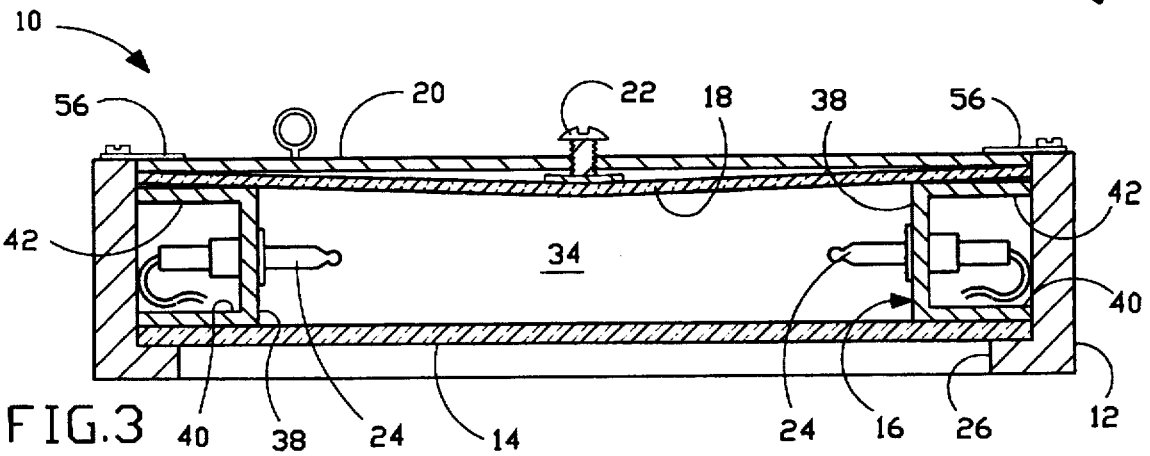
FIG. 3 is an enlarged cross-sectional view taken along line 3—3 of FIG. 2.
Figure 4:
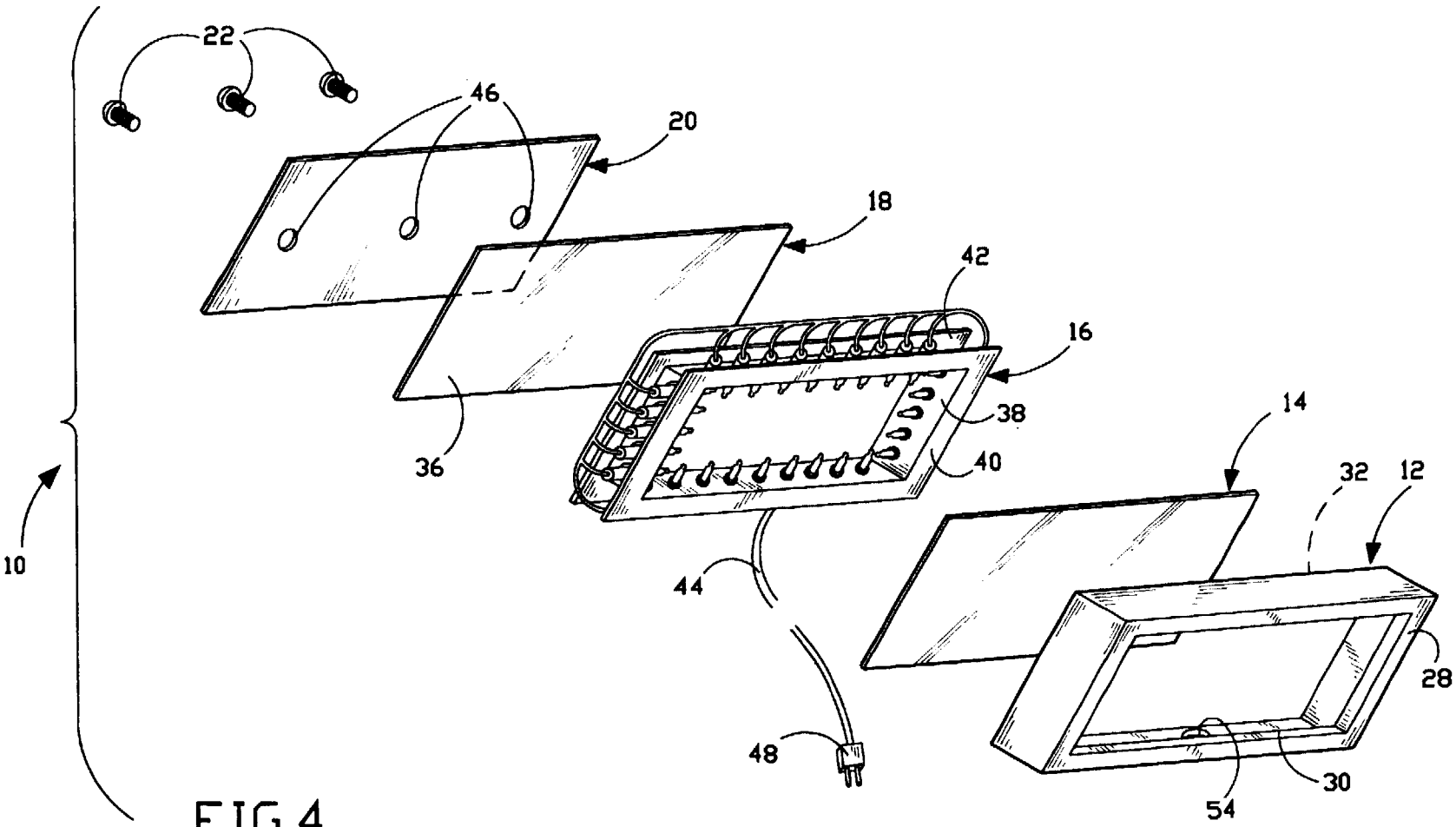
FIG. 4 is an exploded perspective view of the present invention illusion mirror light display.

Referring to FIGS. 3 and 4, the outer frame member 12 has a generally rectangular shape, a front side 28 with a front opening 30 which defines a viewing area, a back side 32 and a cavity 34, wherein a backward facing inner shelf 26 is provided adjacent to the front side 28.

It will be appreciated that the outer frame member 12 is not limited to the rectangular shape. It is emphasized that while the rectangular shape is preferred, it is also within the spirit and scope of the present invention have many different shaped frame members such as a square shape, a circular shape or any other suitable shapes.

The first mirror 14 is shaped to be fitted and assembled within the cavity 34 of the outer frame member 12 and abuts against the backward facing inner shelf 26. The first mirror 14 is preferably a partially reflecting type mirror which is also called a two-way mirror. With the first mirror 14 adjacent to an observer, the first mirror 14 will appear to be fully reflecting.

The second mirror 18 is shaped to be fitted and assembled within the cavity 34 of the outer frame member 12. The second mirror 18 is preferably a fully reflecting mirror which may be a glass pane having a reflecting surface 36.

The inner frame member 16 is shaped to be fitted and assembled within the cavity 34 of the outer frame member 12 and is located between the first and second mirrors 14 and 18 respectively. The inner frame member 16 is constructed with two opposite parallel surrounding sidewalls 40 and 42, and an interior surrounding support wall 38 integrally connected to and between the two parallel surrounding sidewalls 40 and 42. The plurality of light bulbs 24 are installed on the interior surrounding support wall 38 of the inner frame member 16, where the plurality of light bulbs 24 face each other. The light bulbs 24 are interconnected electrically by a wire or cable to each other and into a power cord 44 with a plug 48 at one end for plugging into an electrical wall outlet and providing electrical power to the light bulbs 24. The power cord 44 is inserted through an aperture 54 provided on the outer frame member 12. The light bulbs 24 may be an incandescent bulb. It is also within the spirit and scope of the present invention to have the power source be battery means rather than electrical power.

Figure 2:
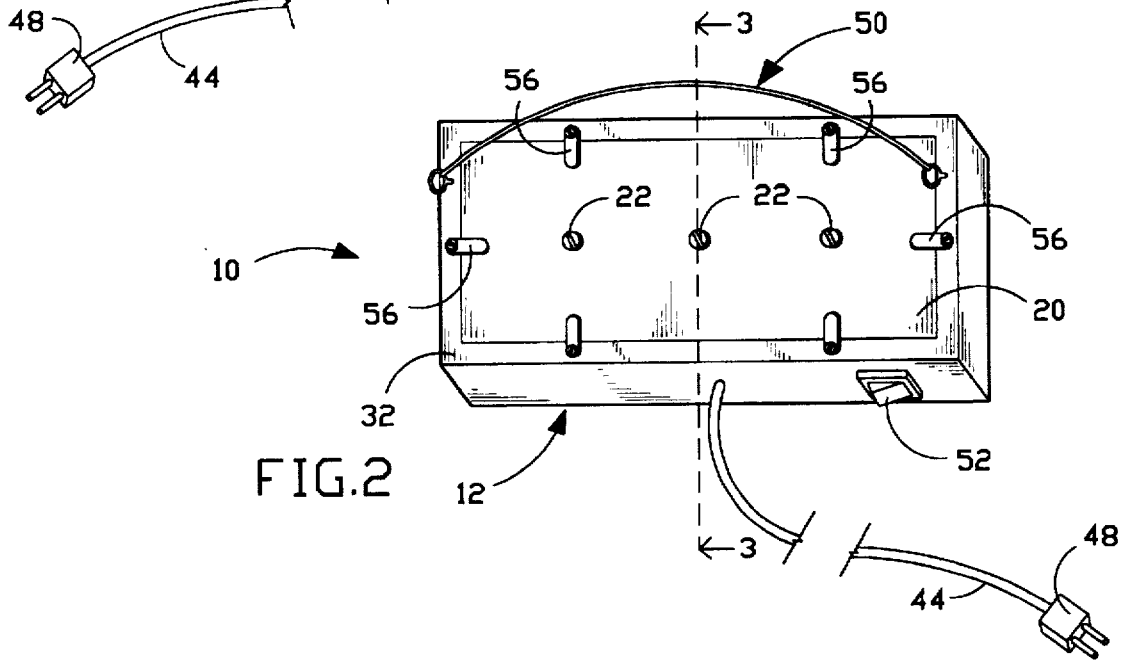
FIG. 2 is a rear perspective view of the present invention illusion mirror light display.

Referring to FIGS. 2, 3 and 4, the backing member 20 is shaped to be fitted and assembled within the cavity 34 of the outer frame member 12. The backing member 20 is positioned adjacent to and flush with the back side 32 of the outer frame member 12 and abuts against the second mirror 18 (see FIG. 3) for retaining the first and second mirrors 14 and 18, and the inner frame member 16 in the cavity 34 of the outer frame member 12. The backing member 20 is retained thereto by pivotable latches 56 which are attached to the back side 32 of the outer frame member 12. The backing member 20 further has three spaced apart threaded apertures 46 therethrough.

The three adjustable screw means 22 are respectively threaded within the three spaced apart apertures 46 of the backing member 20. The three screw means 22 provide pressure points to the back of the second mirror 18 for applying pressure and bending the second mirror 18 inwardly to redirect the successive images from the light bulbs 24 so that the successive images will emit at a different direction or location. In other words, if the pressure point is located adjacent to the left side of the light display 10, the successive images from the light bulbs will emit or deflect to the left side of the light display 10 or if the pressure point is located adjacent to the right side of the light display 10, the successive images from the light bulbs will emit or deflect to the right side of the light display 10. The successive images from the light bulbs will emit where the pressure point is located. The screw means 22 may be a felt pad attached to the back of the second mirror 18.

Because the second mirror 18 is located behind the first mirror 14, the observer will also see the image of the light bulbs 24 which is reflected from the second mirror 18. Moreover, another image of the light bulb 24 is reflected from the first mirror 14 to the second mirror 18 and then back to the observer. Each successive image diminishes in size and intensity and so appears farther away and less bright. These successive images are viewed through the first mirror 14 at the viewing area 30 of the outer frame member 12, thereby providing a visual effect.

Referring to FIG. 2, the present invention illusion mirror light display 10 further comprises hanging means 50 for hanging the illusion mirror light display 10 on a wall. The hanging means may be attached to the back side 32 of the outer frame member 12. The hanging means may include two opposite loop screws threadedly attached to the back side 32 of the outer frame member 12 and a wire tied between the two loop screws.

A power switch 52 is provided with the illusion mirror light display 10 for activating and deactivating the light bulbs 24.

It will be appreciated that the first mirror is not limited to a partially reflective mirror. It is emphasized that while it is preferred to have a partially reflective mirror, it is also within the spirit and scope of the present invention to have the first mirror be a glass pane having see-thru properties and a portion of the back surface having reflective properties.

Defined in detail, the present invention is an illusion mirror light display, comprising: (a) an outer frame member having a front side with a front opening defining a viewing area, a back side and a cavity therethrough, wherein a backward facing inner shelf is provided adjacent to the front side; (b) a first mirror being partially reflecting and shaped to be fitted within the cavity of the outer frame member and located adjacent to the backward facing inner shelf and displayed in the viewing area; (c) a second mirror shaped to be fitted within the cavity of the outer frame member and having a fully reflecting surface spaced from the first mirror; (d) an inner frame member shaped to be fitted within the cavity of the outer frame member and located between the first and second mirrors; (e) a plurality of light sources electrically interconnected to each other and installed on the periphery of the inner frame member and powered through a power means, where the plurality of light sources cause successive images to appear as continuos light lines and displayed in the viewing area of the outer frame member; (f) a backing member shaped to be fitted within the cavity of the outer frame member and positioned adjacent to and flush with the back side of the outer frame for retaining the first and second mirrors, and the inner frame member in the cavity of the outer frame member; (g) at least one screw means threaded to the backing member for providing pressure to move the second mirror inwardly towards the first mirror so that the second mirror is slightly bent to redirect the successive images from the plurality of light sources to emit at a different location; and (h) means for securing the backing member to the outer frame member; (i) whereby the successive images can be viewed through the first mirror at the viewing area of the outer frame member, thereby providing a visual effect.

Defined broadly, the present invention is a mirror light display, comprising: (a) an outer frame having a front opening defining a viewing area and a cavity therethrough; (b) a first mirror being partially reflecting and assembled within the cavity of the outer frame and displayed in the viewing area; (c) a second mirror assembled within the cavity of the outer frame and having a fully reflecting surface spaced from the first mirror; (d) an inner frame assembled within the cavity of the outer frame and located between the first and second mirrors; (e) a plurality of light sources interconnected to each other and installed on the periphery of the inner frame and powered by a power means, where the plurality of light sources cause successive images to appear as continuos light lines and displayed in the viewing area of the outer frame; and (f) at least one pressure point attached to the second mirror for providing pressure so that the second mirror is slightly bent to redirect the successive images from the plurality of light sources to emit at a different location; (g) whereby the successive images can be viewed through the first mirror at the viewing area of the outer frame, thereby providing a visual effect.

Defined more broadly, the present invention is a light display, comprising: (a) a frame having a viewing area; (b) a first mirror assembled within the frame and displayed in the viewing area and having a back surface with a portion being partially reflective; (c) a second mirror assembled within the frame and having a fully reflecting surface spaced from the back surface of the first mirror; (d) at least one light source located between the first and second mirrors and causing successive images to appear as continues light lines and displayed in the viewing area of the frame; and (e) at least one pressure point coming in contact with the second mirror for providing pressure so that the second mirror is slightly bent to redirect the successive images from the at least one light source to emit at a different location; (o) whereby the successive images can be viewed through the first mirror at the viewing area of the outer frame, thereby providing a visual effect.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An illusion mirror light display, comprising:

a. an outer frame member having a front side with a front opening defining a viewing area, a back side and a cavity therethrough, wherein a backward facing inner shelf is provided adjacent to the front side;

b. a first mirror being partially reflecting and shaped to be fitted within said cavity of said outer frame member and located adjacent to said backward facing inner shelf and displayed in said viewing area;

c. a second mirror shaped to be fitted within said cavity of said outer frame member and having a fully reflecting surface spaced from said first mirror;

d. an inner frame member shaped to be fitted within said cavity of said outer frame member and located between said first and second mirrors;

e. a plurality of light sources electrically interconnected to each other and installed on the periphery of said inner frame member and powered through a power means, where the plurality of light sources cause successive images to appear as continuos light lines and displayed in said viewing area of said outer frame member;

f. a backing member shaped to be fitted within said cavity of said outer frame member and positioned adjacent to and flush with said back side of said outer frame for retaining said first and second mirrors, and said inner frame member in said cavity of said outer frame member;

g. at least one screw means threaded to said backing member for providing pressure to move said second mirror inwardly towards said first mirror so that said second mirror is slightly bent to redirect said successive images from said plurality of light sources to emit at a different location; and h. means for securing said backing member to said outer frame member;

i. whereby said successive images can be viewed through said first mirror at said viewing area of said outer frame member, thereby providing a visual effect.

2. The illusion mirror light display in accordance with claim 1 further comprising hanging members for hanging said illusion mirror light display.

3. The illusion mirror light display in accordance with claim 1 wherein said power means is electrical power.

4. The illusion mirror light display in accordance with claim 1 further comprising means for activating and deactivating said plurality of light sources.

5. The illusion mirror light display in accordance with claim 4 wherein said means for activating and deactivating includes a switch.

6. The illusion mirror light display in accordance with claim 1 wherein said plurality of light sources include an incandescent bulb.

7. The illusion mirror light display in accordance with claim 1 wherein said means for securing said backing member to said outer frame member includes pivotable latches.

8. A mirror light display, comprising:

a. an outer frame having a front opening defining a viewing area and a cavity therethrough;

b. a first mirror being partially reflecting and assembled within said cavity of said outer frame and displayed in said viewing area;

C. a second mirror assembled within said cavity of said outer frame and having a fully reflecting surface spaced from said first mirror;

d. an inner frame assembled within said cavity of said outer frame and located between said first and second mirrors;

e. a plurality of light sources interconnected to each other and installed on the periphery of said inner frame and powered by a power means, where the plurality of light sources cause successive images to appear as continues light lines and displayed in said viewing area of said outer frame; and f. at least one pressure point attached to said second mirror for providing pressure so that said second mirror is slightly bent to redirect said successive images from said plurality of light sources to emit at a different location;

g. whereby said successive images can be viewed through said first mirror at said viewing area of said outer frame, thereby providing a visual effect.

9. The mirror light display in accordance with claim 8 further comprising a backing member assembled within said cavity of said outer frame for retaining said first and second mirrors, and said inner frame in said cavity of said outer frame.

10. The mirror light display in accordance with claim 9 further comprising means for securing said backing member to said outer frame.

11. The mirror light display in accordance with claim 10 wherein said means for securing said backing member to said outer frame includes pivotable latches.

12. The mirror light display in accordance with claim 8 further comprising hanging members for hanging said mirror light display.

13. The mirror light display in accordance with claim 8 wherein said power means is electrical power.

14. The mirror light display in accordance with claim 8 further comprising a switch means for activating and deactivating said plurality of light sources.

15. The mirror light display in accordance with claim 8 wherein said plurality of light sources include an incandescent bulb.

16. The light display in accordance with claim 8 wherein said at least one pressure point includes a screw means for pushing and bending said second mirror.

17. A light display, comprising:

a. a frame having a viewing area;

b. a first mirror assembled within said frame and displayed in said viewing area and having a back surface with a portion being partially reflective;

c. a second mirror assembled within said frame and having a fully reflecting surface spaced from said back surface of said first mirror;

d. at least one light source located between said first and second mirrors and causing successive images to appear as continuos light lines and displayed in said viewing area of said frame; and e. at least one pressure point coming in contact with said second mirror for providing pressure so that said second mirror is slightly bent to redirect said successive images from said at least one light source to emit at a different location;

f. whereby said successive images can be viewed through said first mirror at said viewing area of said outer frame, thereby providing a visual effect.

18. The light display in accordance with claim 17 further comprising a backing member assembled in said frame for retaining said first and second mirrors in said frame.

19. The light display in accordance with claim 18 further comprising pivotable latches for securing said backing member to said frame.

20. The light display in accordance with claim 17 wherein said at least one light source includes an incandescent bulb.

21. The light display in accordance with claim 17 wherein said at least one pressure point includes a screw means for pushing and bending said second mirror.

* * * * *